United States Patent [19]

Seiderman

[11] 4,085,468

[45] Apr. 25, 1978

[54] CUSHIONED TOILET SEAT ASSEMBLY

[76] Inventor: Abe Seiderman, 7365 SW. 132 St., Miami, Fla.

[21] Appl. No.: 765,084

[22] Filed: Feb. 3, 1977

[51] Int. Cl.[2] ..... A47K 13/02

[52] U.S. Cl. ..... 4/237

[58] Field of Search ..... 4/DIG. 8, 237; 5/345; 297/452; 428/137

[56] References Cited

U.S. PATENT DOCUMENTS

| | | | |
|---|---|---|---|
| 547,115 | 10/1895 | Green | 4/237 X |
| 582,247 | 5/1897 | Weston et al. | 4/237 X |
| 2,089,254 | 8/1937 | Fitzgerald | 428/137 |
| 2,138,440 | 11/1938 | Boardman | 5/345 R |

FOREIGN PATENT DOCUMENTS

| | | | |
|---|---|---|---|
| 2,222,201 | 10/1974 | France | 5/345 R |

*Primary Examiner*—Charles E. Phillips
*Attorney, Agent, or Firm*—Ernest H. Schmidt

[57] ABSTRACT

A cushioned toilet seat assembly wherein the seat and cover members are each fabricated with a pair of upper and lower base members upholstered about the respective tops and bottoms thereof, and wherein the covering material overlaps and is affixed to relative marginal portions of the respective base members in such a manner as to minimize abutting interference upon final gluing together of the assembly under pressure. Aligned through openings in the upper and lower base members permit extrusion of hot glue therethrough for heading over at the insides of the base members to simulate inter-riveting thereof upon cooling of the glue.

6 Claims, 5 Drawing Figures

CUSHIONED TOILET SEAT ASSEMBLY

This invention relates to a cushioned toilet seat assembly and is directed particularly to a novel and improved method and means for the fabrication of the seat and cover members of such assemblies.

In general, cushioned toilet seats are fabricated by applying a comparatively thick layer of the cushioning material, such as foamed rubber or foamed plastic, against the top surface of relatively thin and hard support base and covering such assembly with a tightly drawn outer skin or layer of sheet vinyl or the like synthetic plastic material. Various methods and devices have heretofore been employed to secure the outer covering in place. Commonly, the vinyl covering material is applied to fully enclose the structure, and heat-sealed along abutting junctures. Another method involves fabricating the base of the cushioned seat or cover of two parts, each of which is marginally overlapped by the outer covering material and there secured in place, after which the two outside covered base members are secured in face-to-face relation to complete the assembly. The present invention is directed particularly to improvements in this latter method of construction.

It is the principal object of this invention to provide a novel and improved method and means for assembling cushioned toilet seat and cover members wherein heat-sealing is not relied on to assemble the upper and lower covering members in place.

It is another object of this invention to provide a method and means for assembling cushioned toilet seat and cover members of the type having individually covered upper and lower sections glued or otherwise secured together wherein such close interfit is achieved as will render the parting line of the inter-assembled upper and lower portions practically invisible.

Another object of the invention is to provide a cushioned toilet seat and associated cushioned cover wherein the respective upper and lower base portions will remain so tightly attached to one another as to eliminate any possibility of their separation except by the use of such force as would destroy the upper and lower backing members before parting at the glue line.

A more particular object of the invention is to provide a cushioned toilet seat or seat cover of the above nature wherein the overlapping marginal portions of the covering material on their respective upper and lower base members are secured in place by relatively offset rows of attachment staples or the like to prevent abutting interference therebetween upon their face-to-face assembly, and wherein the upper and lower base members are further formed with a plurality of mutually aligned through openings providing for the through passage and extrusion of glue during the gluing and face-to-face clamping operation, thereby effectively riveting said upper and lower base portions together.

A salient feature of my invention resides in the fact that, since it is not dependent upon heat-sealing of the covering material, a wide variety of seat covering or upholstering materials other than pure vinyl sheeting can be used, such as vinyl or other plastic or waterproof material backed with a supportive knitted or woven fabric. The invention thus permits the use of cushioned seat cover materials of a wide variety of different textures, ornamental finishes, etc., other than obtainable with pure vinyl and which are substantially stronger and more durable than the pure vinyl covering material necessitated by methods of fabrication relying upon vinyl heat-sealing.

Other objects, features and advantages of the invention will be apparent from the following description when read with reference to the accompanying drawings. In the drawings, wherein like reference numerals denote corresponding parts throughout the several views.

Figure 1:
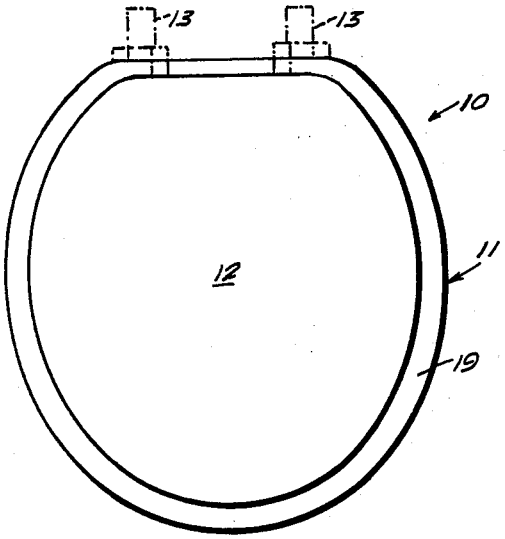
FIG. 1 is a top view of a typical toilet seat assembly embodying the invention.
Figure 2:
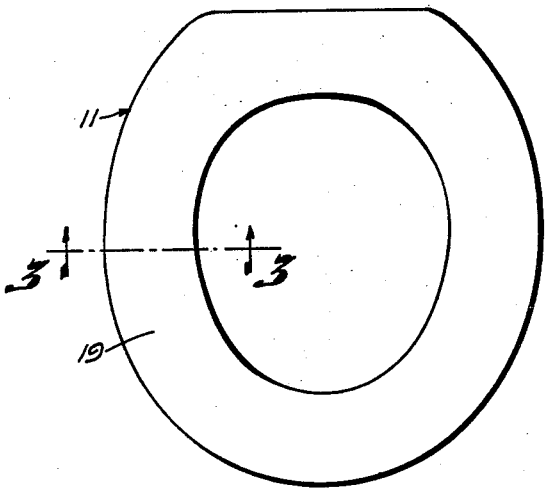
FIG. 2 is a top view of the cushioned seat member, shown separately.

Referring now in detail to the drawings, reference numeral 10 designates, generally, a padded or cushioned toilet seat assembly embodying the invention, the same comprising seat member 11 and a cover member 12 which, in use, will be hinged together in use by the usual hinges 13, indicated in broken lines in FIG. 1 and which are adapted for connection with the bowl of a toilet in the usual fashion.

Since the inventive features herein described and claimed apply equally to the seat member 11 and seat cover member 12, both being cushioned, fabrication of said seat member only will now be described in detail by way of example.

Figure 3:
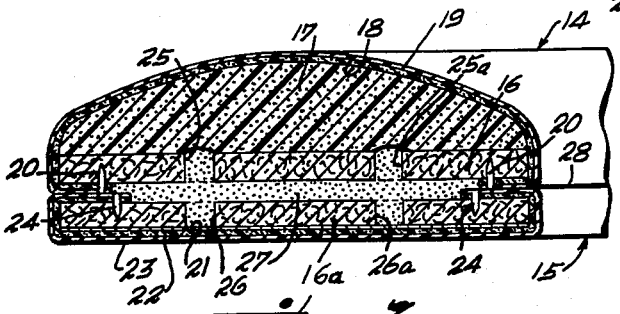
FIG. 3 is a vertical cross-sectional view taken along the line 3—3 of FIG. 2 in the direction of arrows.
Figure 4:
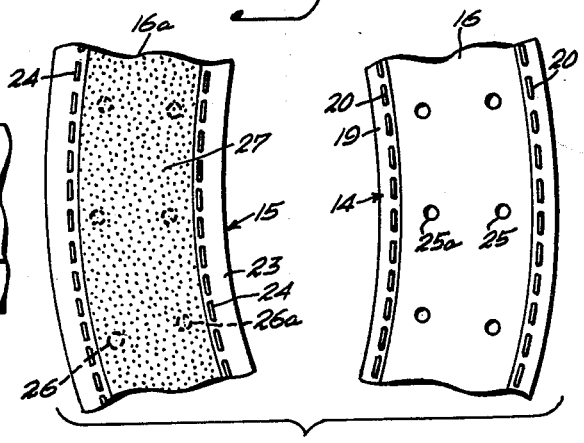
FIG. 4 is a partial view of separated upper and lower portions of the seat member illustrated prior to their face-to-face gluing together under pressure; and, FIG. 5 is an exploded view of the individual parts of the cushioned seat member prior to inter-assembly as in FIG. 3.
Figure 5:
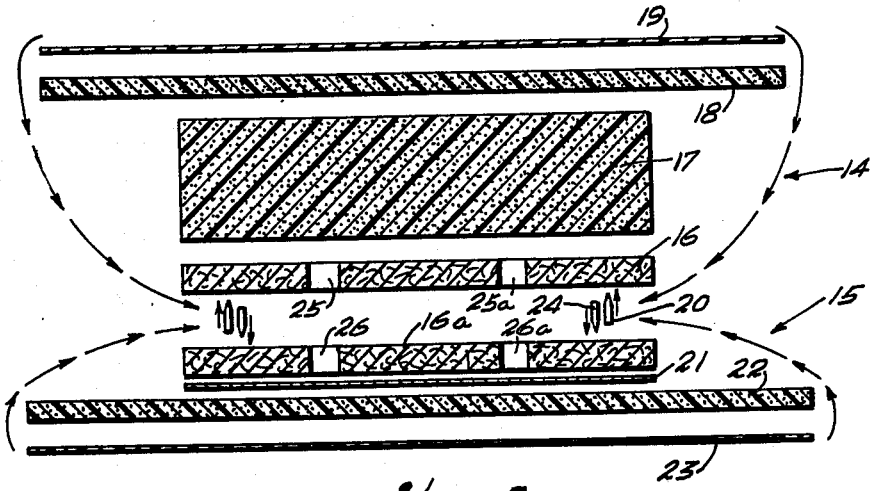

Referring now to FIGS. 3, 4 and 5, the seat member 11 comprises upper and lower members 14 and 15, respectively, which are individually assembled (see FIG. 4) and then glued together in the manner hereinafter more particularly described. Referring to FIG. 5, and considering first the assembly of the upper seat member 14, the same comprises a flat backing member 16, which will preferably be constructed of fibrous hard board, having the general peripheral shape of the finished seat member, i.e. of generally annular configuration. Placed in successive layers upon the upper surface of the hardboard backing member 16 are a cushioning layer of foamed material 17, a comparatively thin enveloping layer of foamed material 18, and a covering or outer layer of surface finish material such as fabric backed vinyl material. As best illustrated in FIG. 3, although of the same general peripheral shape, the enveloping layer 18 and cover sheet layer 19 are somewhat greater in width so as to enable their being stretched over and around the cushioning layer 17 and the backing member 16 to be marginally secured in place thereunder by a series of peripherally extending staples 20.

The lower member 15 of the seat member 11 similarly comprises a hardboard or the like backing member **16*a* against the underside of which is placed a heavy paper separating layer 21 followed, in succession, by an enveloping layer of foamed plastic 22, and a finish or cover layer 23, such as of fabric backed vinyl material. As in the assembly of the upper member 14 as described above, outer marginal portions of the foamed plastic enveloping layer and the outer fabric backed vinyl material cover layer 22, 23 respectively, are stretched around the underside of the backing member 16*a* to be secured about upper marginal portions thereof by the use of staples 24. In this connection it is to be seen, with particular reference to FIGS. 3 and 4, that the overlapping stapled portions of the upper member 14 are of somewhat lesser inward extent than the overlapping portions of the lower member 15, and that the rows of staples 20 are correspondingly outwardly offset with respect to the row of stapls 24** so that, upon pressurized gluing inter-assembly of said upper and lower members, said staple rows will not be placed in inter-abutting relationship, thereby to provide for the utmost compact assembly in the manner now to be described.

A salient feature of the invention relating to the inter-gluing attachment of the upper and lower seat members 14 and 15, resides in the provision, in the backing members 16 and **16*a*, of rows of through openings 25, 25*a* and 26, 26*a*, respectively, said rows of through openings being identically placed, such as by being drilled while in vertically stacked relation prior to assembly so as to be in registration for vertical alignment as individual pairs of such openings as illustrated in FIGS. 3 and 5**.

As described in my co-pending U.S. patent application Ser. No. 648,141, filed Jan. 12, 1976, entitled AUTOMATIC HOT MELT ADHESIVE DEPOSITING MACHINE, isued as U.S. Pat. No. 4,056,075 on Nov. 1, 1977, secured inter-assembly of the prefabricated upper and lower members 14 and 15 of the seat member 11 is effected by depositing a layer of hot glue 27 on the exposed surface of the backing member **16*a*, and then assembling thereto, under sustained pressure, the upper member 14. As illustrated in FIG. 3, such pressure exerted in squeezing the upper and lower members 14 and 15 together forces the hot glue fully into and through the aligned opening pairs 25, 25*a* and 26, 26*a* so that, upon hardening, they act much in the same manner as rivets might in the securement each to the other of the backing members 16 and 16*a*. The bonding thus achieved renders the seat assembly 11 extraordinarily strong and practically indestructable, even under the most adverse conditions of usage. The relative off-setting of the staple rows 20 and 24 obviates interference therebetween, thus enhancing the compact inter-assembly of the upper and lower members 14 and 15 so that the parting line 28** is practically invisible.

As described above, the cover member 12 is fabricated similarly to that of the seat member 11, the principal difference being that there is no central opening and marginal attachment of the corresponding parts is effected about the outer periphery of the corresponding upper and lower cover member parts.

While I have illustrated and described herein only one form in which my invention can conveniently be embodied in practice it is to be understood that this form is given by way of example only and not in a limiting sense. My invention, in brief, comprises all the embodiments and modifications coming within the scope and spirit of the following claims.

What I claim as new and desire to secure by Letters Patent is:

1. A cushioned toilet seat member, comprising, in combination, a pair of substantially flat upper and lower base members, upholstery material covering the respective top and bottom of said upper and lower base members, a cushioning material interposed between said upholstery material and said upper base member said upholstery material comprising outer sheet material layers surrounding peripheral edge portions of their respective upper and lower base members and terminating in marginal portions overlapping the respective bottom and top of said upper and lower base members, means tacking said marginal overlapping portions to the bottom and top of said upper and lower base members, respectively, a plurality of aligned through openings in said upper and lower base members, and glue means for securing the respective bottom and top of said upper and lower base members in aligned, face-to-face engagement, said glue means comprising hardened glue extending through voids defined by aligned ones of said pluralities of openings to simulate riveting together of said upper and lower base members.

2. A cushioned toilet seat member as defined in claim 1, wherein said glue means comprises a layer of glue between said upper and lower base members and integrally formed with said hardened glue.

3. A cushioned toilet seat member as defined in claim 2, wherein said means tacking said marginal overlapping portions to the bottom and top of said upper and lower base members, respectively, comprises a continuous line of staples laterally spaced from and substantially following the contour of the outer peripheral edges of each of the respective upper and lower base members.

4. A cushioned toilet seat member as defined in claim 3, wherein said lateral spacing of the line of rivets of one of said upper and lower base members is greater than the lateral spacing of the line of rivets of the other of said upper and lower base members.

5. A cushioned toilet seat member as defined in claim 4, wherein said upholstery material further comprises an enveloping layer of foamed plastic under and coextensive with each of said outer sheet material layers.

6. A cushioned toilet seat member as defined in claim 5, wherein said cushioning material further comprises a cushioning layer of foamed plastic material of substantially the same peripheral size as said upper base member and sandwiched between the outside of said upper base member and said overlapping layer and said enveloping layer of foam plastic.

* * * * *